US008615441B1

(12) United States Patent
Fuss et al.

(10) Patent No.: US 8,615,441 B1
(45) Date of Patent: Dec. 24, 2013

(54) AUTOMATED ORDER ROUTING

(75) Inventors: Christopher Carl Fuss, Akron, OH (US); Michael Joseph Hitmar, Cary, NC (US); Jeffrey Scott Comer, Hinkley, OH (US); John Patrick Kelly, Hudson, OH (US); Brian Paul Thomas, Streetsboro, OH (US); Scott Christopher Morman, Akron, OH (US)

(73) Assignee: OE Connection LLC, Richfield, OH (US)

( * ) Notice: Subject to any disclaimer, the term of this patent is extended or adjusted under 35 U.S.C. 154(b) by 279 days.

(21) Appl. No.: 12/952,437

(22) Filed: Nov. 23, 2010

(51) Int. Cl.
*G06Q 30/00* (2012.01)

(52) U.S. Cl.
USPC ..... 705/26.1

(58) Field of Classification Search
USPC ..... 705/26.1, 26.2, 26.25, 26.3, 26.35, 705/26.4, 26.41–26.44, 26.5, 26.61–26.64, 705/26.7, 26.8, 26.81, 26.82, 26.9, 27.1, 705/27.2
See application file for complete search history.

(56) References Cited

U.S. PATENT DOCUMENTS

| | | | | |
|---|---|---|---|---|
| 6,741,970 | B2 | 5/2004 | Smith et al. | |
| 7,174,308 | B2 * | 2/2007 | Bergman et al. | 705/27.1 |
| 7,860,796 | B2 * | 12/2010 | Levy | 705/45 |
| 2001/0034659 | A1 | 10/2001 | Kobayashi | |
| 2002/0002501 | A1 | 1/2002 | Reyda et al. | |
| 2002/0077937 | A1 * | 6/2002 | Lyons et al. | 705/28 |
| 2003/0144914 | A1 | 7/2003 | Gossard et al. | |
| 2006/0080219 | A1 * | 4/2006 | Lutnick et al. | 705/37 |
| 2007/0038524 | A1 | 2/2007 | Fiechter et al. | |
| 2012/0072297 | A1 * | 3/2012 | Chou | 705/26.3 |
| 2013/0211945 | A1 * | 8/2013 | Po-Ching | 705/26.3 |

OTHER PUBLICATIONS

Donna L. Hoffman et al. "How to Acquire Customers on the Web", Harvard Business Review, May-Jun. 2000.*

* cited by examiner

*Primary Examiner* — Naeem Haq
(74) *Attorney, Agent, or Firm* — Ralph E. Jocke; Daniel D. Wasil; Walker & Jocke

(57) ABSTRACT

Technologies described herein relate to automated order routing. A consumer can place an order for a product with a first retailer, wherein the first retailer is the preferred retailer of the consumer. If the first retailer fails to commit to fulfilling the order within a threshold amount of time, at least one other retailer is selected, and the order for the product is automatically routed to the at least one other retailer. The first retailer that commits to fulfilling the order acquires the sale.

24 Claims, 8 Drawing Sheets

AUTOMATED ORDER ROUTING

BACKGROUND

E-commerce applications have advanced such that many individuals would prefer to shop for and purchase products through online systems than travel to brick and mortar stores. This preference is based at least in part upon convenience of price comparing without having to travel to a brick and mortar store, convenience of receiving the desired products at the home of the individual, amongst other factors. Typically, when an individual wishes to purchase a product, she will utilize an Internet browser to access a web page corresponding to a retailer. The user will then select a product that is offered for sale by such retailer and provide the retailer with account information, such as a credit card number, a debit card number, etc. to purchase a product. The retailer fulfills the order and ships the product to an address specified by the individual.

In most scenarios, this interaction is mutually beneficial to the consumer and the retailer. That is, the consumer selects the product to purchase and the retailer confirms such purchase and ships the product to the user in a timely manner. In some corporate/franchise business structures, however, this arrangement operates sub-optimally, especially from the perspective of the consumer. In a particular example, a corporation that manufactures automobiles may have several independently operating franchises that are contracted to sell automobiles to consumers. While these franchises can be thought of as independent entities, since they are selling under the brand of the automobile manufacturing corporation their performance as franchises can have an effect on the image of the automobile manufacturer to the general public. Thus, if a franchise treats a consumer improperly, the consumer will have negative feelings toward the automobile manufacturer.

Conventionally, when a consumer wishes to purchase an automobile part from a particular franchise, the consumer picks up the telephone and calls such franchise to place an order for the automobile part. The parts department of the franchise then checks inventory at the franchise to see if the part is available. If the part is available at the franchise, the franchise can commit to fulfilling the order, such that the franchise agrees to provide the consumer with the requested automobile part(s) for an agreed upon price. In some cases, however, the parts department may forget to check inventory or otherwise neglect to commit to fulfilling the order in a timely fashion. Accordingly, the consumer must again call the franchise or begin calling other franchises that may have the desired product in stock. To alleviate some of such difficulties in conventional parts ordering, some automobile franchises have set up e-commerce applications such that consumers can direct an Internet browser to a web page of the automobile franchise and place an order for desired automobile parts through such web page. Even with franchises that have adapted such an e-commerce application, the problem described above with respect to the franchise committing to the order remains. That is, the order is transmitted electronically to the franchise and the franchise must then commit to the order. Oftentimes, franchises fail to commit to order in a timely manner, which again negatively reflects on the automobile manufacturer.

SUMMARY

The following is a brief summary of subject matter that is described in greater detail herein. This summary is not intended to be limiting as to the scope of the claims.

Described herein are various technologies pertaining to automatically routing product orders to retailers to ensure that retailers commit to fulfilling the product orders in a timely manner. A consumer can access an e-commerce application, for instance, by directing a web browser to a particular web page. On this web page the consumer can place an order for a particular product that may be available through multiple retailers. Thereafter, the consumer can select a preferred retailer, and can further indicate that the order for the product can be routed to the preferred retailer. Subsequent to the order being routed to the preferred retailer, a clock can be initialized. The clock is monitored to see if a threshold amount of time has passed. Prior to the passage of this threshold amount of time, the preferred retailer can have exclusive rights to committing to fulfilling the order. If the preferred retailer commits to fulfilling the order prior to the passage of the threshold amount of time, then the preferred retailer can fulfill such order.

If, however, the preferred retailer does not commit to fulfilling the order prior to the passage of the threshold amount of time, then the order for the product can be automatically routed to at least one other retailer that can fulfill the order. For example, the at least one other retailer can be selected based at least in part upon geographic location of the at least one other retailer with respect to the geographic location of the user. Once the order has been routed to the at least one other retailer, either the preferred retailer or the at least one other retailer can commit to fulfilling the order of the consumer. This ensures that retailers will be responsive to product orders placed by consumers; otherwise such retailers can lose a significant amount of business.

After the order has been routed to the at least one other retailer, the clock can be monitored for passage of a second threshold amount of time. If either of the preferred retailer or the at least one other retailer commit to fulfilling the order, the first of such retailers that make such commitment will fulfill the order of the consumer. If, however, neither of the preferred retailer nor the at least one other retailer commit to fulfilling the order prior to passage of a second threshold amount of time, a third retailer or manufacturer can automatically commit to fulfilling the order.

In an exemplary embodiment, the retailers described above can be automobile dealers that are franchises of a particular automobile manufacturer. Thus, the preferred retailer can be a first automobile dealer, the at least one other retailer can be another automobile dealer that is relatively proximate to the geographic location of the user, and the third retailer can be a relatively large automobile dealership that has a significant amount of product in stock. In another example, the third retailer can be the automobile manufacturer itself.

Other aspects will be appreciated upon reading and understanding the attached figures and description.

DETAILED DESCRIPTION

Figure 1:
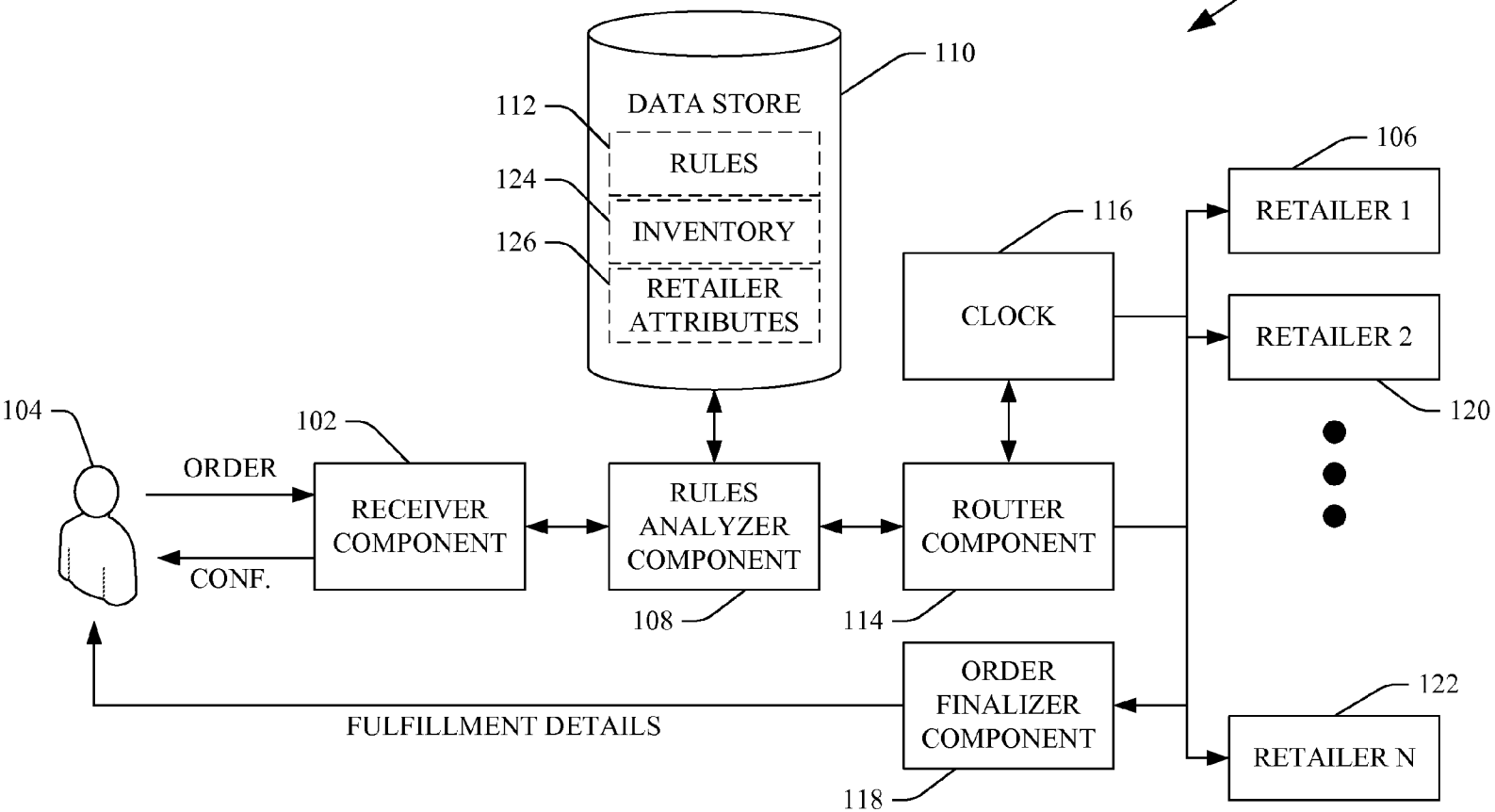
FIG. 1 is a functional block diagram of an exemplary system that facilitates automatically routing product orders to certain retailers.

Various technologies pertaining to automatically routing an order for a product will now be described with reference to the drawings, where like reference numerals represent like elements throughout. In addition, several functional block diagrams of exemplary systems are illustrated and described herein for purposes of explanation; however, it is to be understood that functionality that is described as being carried out by certain system components may be performed by multiple components. Similarly, for instance, a component may be configured to perform functionality that is described as being carried out by multiple components. Additionally, as used herein, the term "exemplary" is intended to mean serving as an illustration or example of something, and is not intended to indicate a preference.

With reference to FIG. 1, an exemplary system 100 that facilitates automatically routing an order for a product to a plurality of different retailers at different points in time is illustrated. In an exemplary embodiment, the system 100 may be resident upon a server that is accessible by way of the Internet. For instance, a consumer can access the system 100 through utilization of a web browser by directing such web browser to a particular web page. Furthermore, a retailer can access the system 100 by way of a web page or client side application that is in communication with the system 100.

The system 100 comprises a receiver component 102 that receives an order from a user 104. The received order can include a product or a plurality of products. In an example, the consumer 104 can access a web page through utilization of a web browser and may select one or more items for purchase on such web page. Additionally, the consumer 104 can select a particular retailer (a first retailer) that is the preferred retailer for the consumer 104. For instance, the first retailer 106 can be a retailer that is relatively proximate geographically to the consumer 104. The order placed by the consumer 104 can have various attributes corresponding thereto. An exemplary attribute includes a manner in which the product in the order is to be provided to the consumer 104 (e.g., by way of a particular shipper, through the user picking up the order at the location of the retailer, the retailer dropping off the ordered product to the consumer 104, etc.). Another exemplary attribute can be a type of account utilized by the consumer 104 to purchase the products in the order. Account types can include credit card, debit card, line of credit, etc. Still yet another exemplary attribute corresponding to the order may be a type corresponding to the consumer 104. For instance, the consumer 104 may be an individual that is purchasing products in the order for personal use. In another example, the consumer 104 may be a business that is purchasing the products in the order for resale.

A rules analyzer component 108 is in communication with the receiver component 102 and analyzes attributes of the order and the consumer 104. Based at least in part upon this analysis, the rules analyzer component 108 can ascertain whether the order of the consumer 104 qualifies for automated order routing.

Specifically, the system 100 can comprise a data store 110 that includes a plurality of rules 112. For instance, a first rule in the rules 112 can indicate that an order only qualifies for automated order routing if the consumer 104 is an end consumer that is utilizing the products in the order for personal use. Another exemplary rule included in the rules 112 may indicate that the order qualifies for automated routing only if the consumer 104 is paying by way of a credit card or debit card. Still yet another exemplary rule that can be included in the rules 112 can indicate that the order only qualifies for automated routing if a particular type of shipping has been selected by the consumer 104. For instance, an order of a product cannot be routed to another retailer if the consumer 104 has agreed to pick up the product from the first retailer 106. Yet another exemplary rule that can be considered by the rules analyzer component 108 is to insure that the price for the products in the order of the consumer 104 cause any of the available retailers to achieve a gross profit margin of a threshold percentage (e.g., 17 percent).

If the rules analyzer component 108 determines that the order is available for automated routing, the rules analyzer component 108 can output data to the receiver component 102 to indicate the availability of automatic routing for such order. The receiver component 102 may then provide the consumer 104 with data that indicates to the consumer 104 that automated routing of the order is available to such consumer 104. Thereafter, the consumer 104 can choose whether or not to have the order automatically routed if the first retailer 106 does not commit to fulfilling the order of the consumer 104 in a timely manner. If the consumer 104 chooses to have the order automatically routed, the consumer 104 can indicate to the receiver component 102 such choice and can finalize the order. Upon the consumer 104 finalizing the order for an agreed upon price, the receiver component 102 can transmit a confirmation to the consumer 104 pertaining to the order. This confirmation can indicate to the consumer 104 that the order placed by the consumer 104 will be fulfilled by a retailer for the agreed upon price. Moreover, at the time the order has been finalized, an authorization for the agreed upon price can be placed on the credit card of the consumer 104 by or on behalf of the first retailer 106.

The system 100 further comprises a router component 114 that, upon receiving an indication from either the receiver component 102 or the rules analyzer component 108 that the order has been placed by the consumer 104, can route the order to the first retailer 106. As described above, the first retailer 106 can be selected by the consumer 104 as the preferred retailer for the consumer 104. The order transmitted to the retailer 106 can include information such as the identity of the consumer 104, products included in the order and prices for such products. The system 100 further comprises a clock 116, wherein the router component 114 initializes the clock 116 upon transmitting the order to the first retailer 106. Additionally a time value pertaining to the clock 116 can be output to the first retailer 106. Such time value together with the order indicates to the first retailer 106 that the first retailer 106 has the exclusive right to commit to fulfilling the order within a certain amount of time before the order is routed to other retailers.

The router component 114 can monitor values output by the clock 116 to ascertain if a first threshold amount of time has passed without the first retailer 106 committing to fulfilling the order by the consumer 104. If the first retailer 106 commits to fulfilling the order prior to the passage of a threshold amount of time, then the first retailer 106 can fulfill such order. An order finalizer component 118 can finalize the order of the consumer 104 and can output a detailed order confirmation to such consumer 104. This order confirmation can include identity of the first retailer 106, the agreed upon price, etc.

If the first threshold amount of time has passed and the first retailer 106 has not committed to fulfilling the order of the consumer 104, then the router component 114 can route the order to at least one of a plurality of other retailers 120-122. At the time of such routing, the router component 114 can also transmit data to the first retailer 106 to indicate to the first retailer 106 that the order is no longer exclusive to the first retailer 106, and that at least one other retailer is able to commit to fulfilling such order. For example, graphical indicia can be provided to an application executing on a computing device at the first retailer 106 to inform the first retailer 106 that the order may be committed to be fulfilled by other online retailers.

After passage of the first threshold amount of time, the router component 114 can be in communication with the rules analyzer component 108 in connection with determining which of the retailers 120-122 are to receive the order. The rules analyzer component 108 can again access the rules 112 and compare such rules with various attributes pertaining to the order, the consumer 104, and/or the retailers 120-122 to determine which of the retailers 120-122 are to be selected to receive the order of the consumer 104.

An exemplary rule that can be included in the rules 112 may require that the retailer to which the order is to be routed currently has the product in inventory. The data store 110 may include inventory 124 and the rules analyzer 108 can check the inventory 124 of the retailers 120-122. The data store 110 can further comprise retailer attributes 126, and the rules analyzer 108 can analyze the retailer attributes 126 in connection with the rules 112 when selecting retailers for order routing. These retailer attributes 126 can include sizes of the retailers 120-122, geographic locations of the retailers 120-122, user ratings given to the retailers 120-122 (previous responsiveness to orders from consumers of the retailers 120-122), classifications of the retailers 120-122, types or brands of products carried by the retailers 120-122, etc. Thus, other exemplary rules pertaining to which of the retailers 120-122 to select for routing the order of the consumer 104 can include a rule that requires a retailer to be within a certain distance of a geographic location of the consumer 104. Another exemplary rule can require that the retailer have a particular rating from consumers. Yet another exemplary rule can require that the retailer be of a particular size or classification, etc.

Subsequent to the router component 114 routing the order of the consumer 104 to the retailers 120-122, one or more of such retailers 120-122 can commit to fulfilling such order. That is, a retailer that commits to fulfilling the order will provide the product to the consumer 104 in exchange for payment from the consumer. In such a case, where the first retailer 106 does not end up committing to the order, the order finalizer component 118 can cause the authorization placed on the credit card by or on behalf of the first retailer 106 to be released. Thereafter, the order finalizer component 118 can place a different authorization on the credit card of the consumer 104 on behalf of or by the retailer that ended up committing to fulfilling the order. Thereafter, the order finalizer component 118 can cause an electronic message to be transmitted to the consumer 104 to indicate details pertaining to the purchase of the product, including the identity of the retailer that committed to the order, an estimated time of arrival of the product to the consumer 104, an amount of sales tax for the product, etc.

It can be understood that there may be some situations where neither the first retailer 106 nor the retailers that were routed the order after the first threshold amount of time passed may commit to fulfilling the order of the consumer 104. Thus, the router component 114 can monitor a value of the clock 116 to ascertain whether such value has passed a second predefined threshold. In an example, the first predefined threshold may be 30 minutes such that the first retailer 106 has the exclusive right to commit to fulfilling the order to the consumer 104 for 30 minutes. After the expiration of 30 minutes, the router component 114 can route the order to other retailers, wherein such retailers are selected through utilization of the rules 112 in the data store 110. The second threshold amount of time may be 15 minutes, such that the first retailer 106 and the retailer to which the order has been routed may have 15 minutes to commit to fulfilling the order. If this second threshold amount of time passes, a particular predefined retailer or manufacturer can automatically commit to fulfilling the order. Accordingly, the consumer 104 can submit an order with confidence knowing that his or her order will be fulfilled whether by the preferred first retailer 106 or some other retailer. Furthermore if the retailers 106-122 are franchises of a particular company, the parent company can have knowledge that a sale to the consumer 104 will not be lost. Moreover, opportunities to individual franchises to complete sales are not lost. Any lost sales can be attributed to the delay of a retailer that has been selected as the preferred retailer.

While the above examples describe the routing of orders in a relatively low number of "waves" (e.g., first to the preferred retailer, then to other retailers, and then to a default retailer or manufacturer), it is to be understood that the system 100 can be implemented to select retailers and route orders in any number of "waves". For instance, exclusive rights can be given to the first retailer 106 for a first threshold amount of time. Thereafter, additional retailers can be selected through use of the rules 112, and the order can be routed to those retailers. If none of these retailers commits to fulfilling the order, then still more retailers can be selected through use of the rules 112, and the order can be routed to these retailers. Thus, the number of "waves" of order routing can be configured as desired by an implementer of the system 100.

Moreover, an implementer of the system 100 can configure order routing to occur only at certain times of the day. For example, a retailer may not be expected to commit to an order at 1:00 a.m. Accordingly, the clock 116 may be initialized and monitored only during times that are configured by the implementer of the system 100. Accordingly, various configurations of the system 100 are contemplated by the inventors and are intended to fall under the scope of the hereto-appended claims.

In an exemplary embodiment, the retailers 106 and 120-122 may be automobile dealers that are franchises of a particular parent automobile manufacturer. In such an embodiment, the consumer 104 can place an order for an automobile part for an automobile owned or operated by the consumer 104. Accordingly, in an example, the consumer 104 can place an order for a particular automobile part and may select a neighborhood dealership as the preferred automobile dealership. Additionally, the consumer 104 can agree choose to have the order automatically routed, so long as the order qualifies for such routing. The local automobile dealership will have the first opportunity to commit to fulfilling the order of the consumer 104, and if the automobile dealership commits to fulfilling the order within the threshold amount of time, will make the profit from the sale. If, however, the automobile dealership is lax in monitoring automobile part sales, then other dealerships can be given the opportunity to commit to the order of the consumer 104. Further, as mentioned above, an agreed upon price between the consumer 104 and the first automobile dealership can include a particular threshold amount of profit, such that any dealership that commits to fulfilling the order may make the particular threshold amount of profit.

If no dealership commits to fulfilling the order of the consumer 104 within some threshold period of time mentioned, then the automobile manufacturer itself can commit to fulfilling the order, thereby keeping the consumer 104 relatively happy with the automobile manufacturer. In another exemplary embodiment, a relatively large dealership may wish to automatically commit to fulfilling any orders that are not committed to by dealerships selected by the router component 114. This can result in increased profits for the relatively larger dealership.

Of course, the system 100 is not limited to automobile dealerships but can be utilized in connection with any suitable corporate/franchise relationship. Moreover, other online e-commerce systems may benefit from the functionality of such system 100. For instance, some online e-commerce companies agree to sell products from individual companies, wherein the e-commerce companies are paid a certain percentage of the total prices of products purchased by consumers from the individual companies. Accordingly, such online retailer can sell products for various companies, wherein such companies are independent but, in certain circumstances, may sell identical goods. In such a case, the consumer can access an e-commerce application and select a product for purchase that is sold by a particular company, wherein such product is sold through the e-commerce application (e.g., www.amazon.com). If the particular company does not commit to fulfilling the order in some threshold period of time, another company can agree to fulfill the order for the price that was agreed upon between the first company and the consumer. Other implementations and business structures will be recognized by one of ordinary skill in the art and are intended to be fall under the scope of the hereto appended claims.

Figure 2:
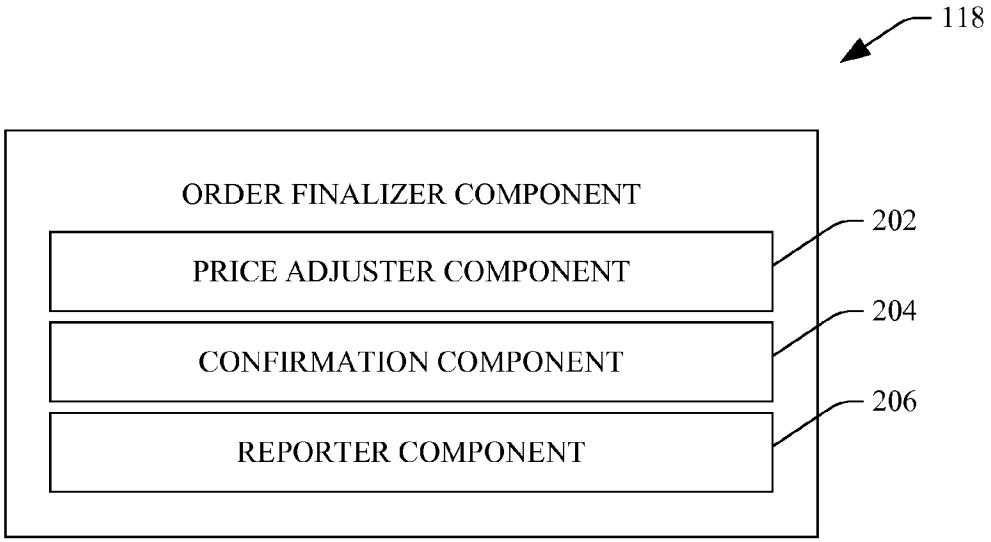
FIG. 2 is a functional block diagram of an exemplary component that facilitates finalizing product orders.

Referring now to FIG. 2, the order finalizer component 118 is shown in greater detail. The order finalizer component 118 can comprise a price adjuster component 202 that adjusts certain portions of a price to ensure that the final price paid by the consumer 104 is the original agreed upon price between the consumer 104 and the first retailer 106. In an example, the consumer 104 can select the first retailer 106 as the preferred retailer, as the first retailer 106 is in geographic proximity to the consumer 104. Additionally the consumer 104 can select to have the products shipped by a particular carrier for a certain shipping price. If the first retailer 106 does not commit to fulfilling the order and another retailer that is further from the consumer 104 commits to fulfilling the order, the cost of shipping may change. It is desirable, however, that if such cost of shipping increases the increase in cost is not passed on to the consumer 104. Accordingly, the price adjuster component 202 can adjust, for accounting purposes, the price of a product such that the final price of the product is the same as the agreed upon price between the consumer 104 and the first retailer 106. In an example, the first retailer 106 can be charged the difference in shipping price. In another example, so long as an appropriate amount of profit is made by the retailer that commits to fulfilling the order, the retailer that committed to filling the order can bear the additional cost of shipping. In yet another, example a manufacturer can bear the change in shipping cost.

Further, the first retailer 106 selected as the preferred retailer by the consumer 104 may be in a state that has a first sales tax rate. Accordingly, the agreed upon price between the consumer 104 and the first retailer 106 can have at least two portions: an original price of the product without considering sales tax, and an amount of sales tax that is to be charged to the consumer 104 for such product. If the order, however, is routed to another retailer in a different state, such state may charge a different amount of sales tax for the purchase of the product. For instance, a retailer that commits to fulfilling the order may be in a second state that has a second sales tax rate, which may be higher than the first sales tax rate. In such a situation, the price adjuster component 202 can adjust the tax-free portion of the price such that the new combination of the tax-free portion of the price and sales tax is equivalent to the previous total price for the product. For instance, if the consumer 104 agrees to pay a total of $20 for a product from the first retailer that is subject to the first sales tax rate, the consumer 104 will pay $20 for the product from the second retailer that is subjected to the second sales tax rate even though the sales tax rates are different. The loss of profits caused by the additional sales tax can be paid by the first retailer, for instance, that fails to commit to fulfilling the order in a timely fashion, can be borne by the second retailer that fulfills the order so long as a threshold amount of profit is made by the second retailer, or can be borne by a manufacturer that is a parent company with franchises.

The order finalizer component 118 can further include a confirmation component 204 that is configured to transmit an electronic message to the consumer 104 that confirms that the order has been committed to by a retailer. Accordingly, the confirmation component 204 can generate an e-mail, a text message, an automated voice message or other suitable electronic communication, wherein such electronic message can include an identity of the retailer that committed to fulfilling the order, a price to be paid by the consumer 104 for the order, an estimated time of arrival of the product(s) in the order to the consumer 104, amongst other data.

The order finalizer component 118 can also include a reporter component 206 that can generate reports to a parent company, wherein the reports can indicate retailer performance with respect to committing to orders submitted by consumers. For example, the parent company may desire that its franchises timely commit to fulfilling orders to keep consumers relatively happy. The reporter component 206 may, for instance, generate reports that indicate that a particular retailer is not timely committing to fulfilling orders. Additionally, the reporter component 206 can generate reports to managers showing that certain departments are not committing to fulfilling orders in a timely manner.

Figure 3:
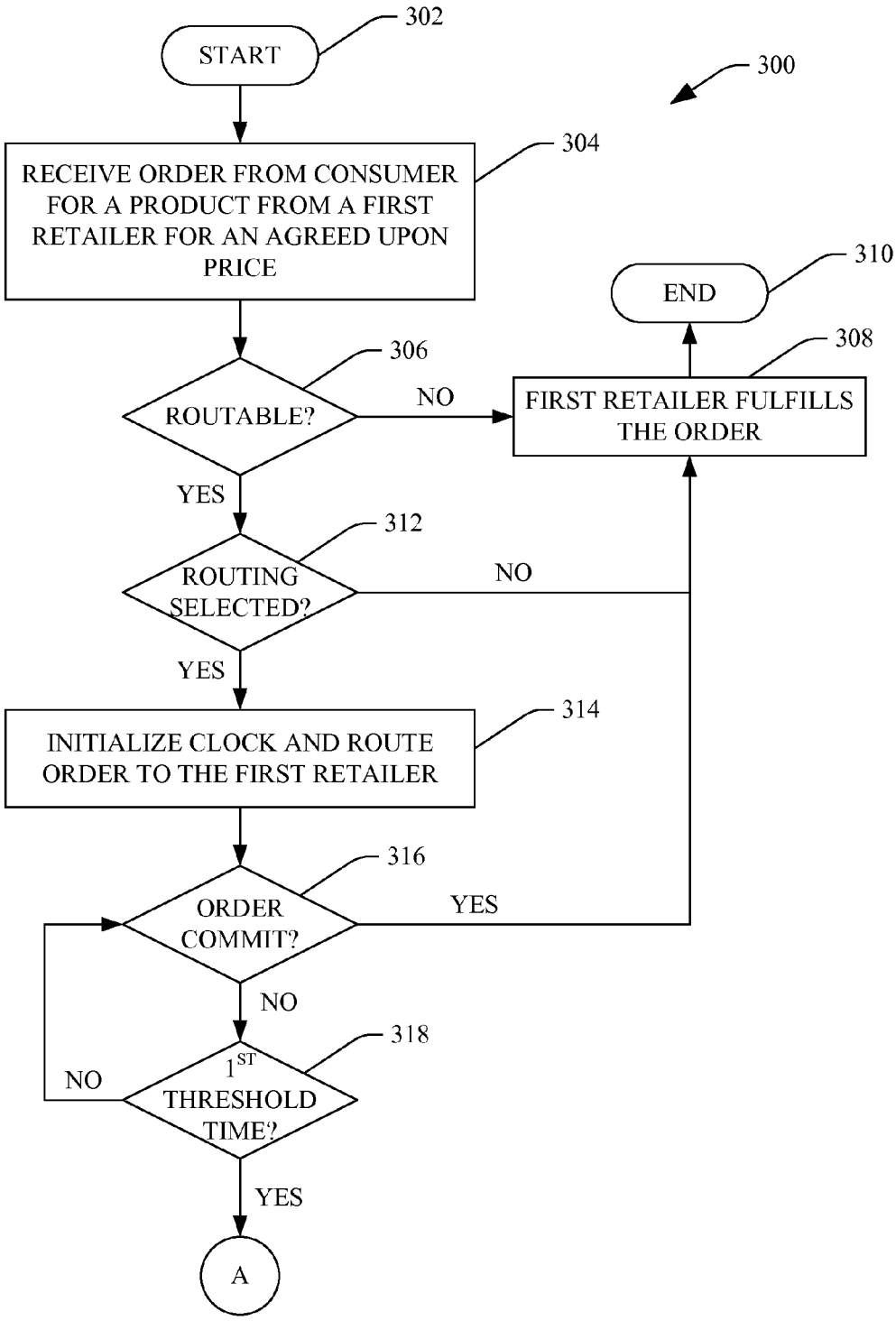
FIGS. 3 and 4 illustrate an exemplary methodology that facilitates automatically routing an order for a product to a plurality of retailers.
Figure 4:
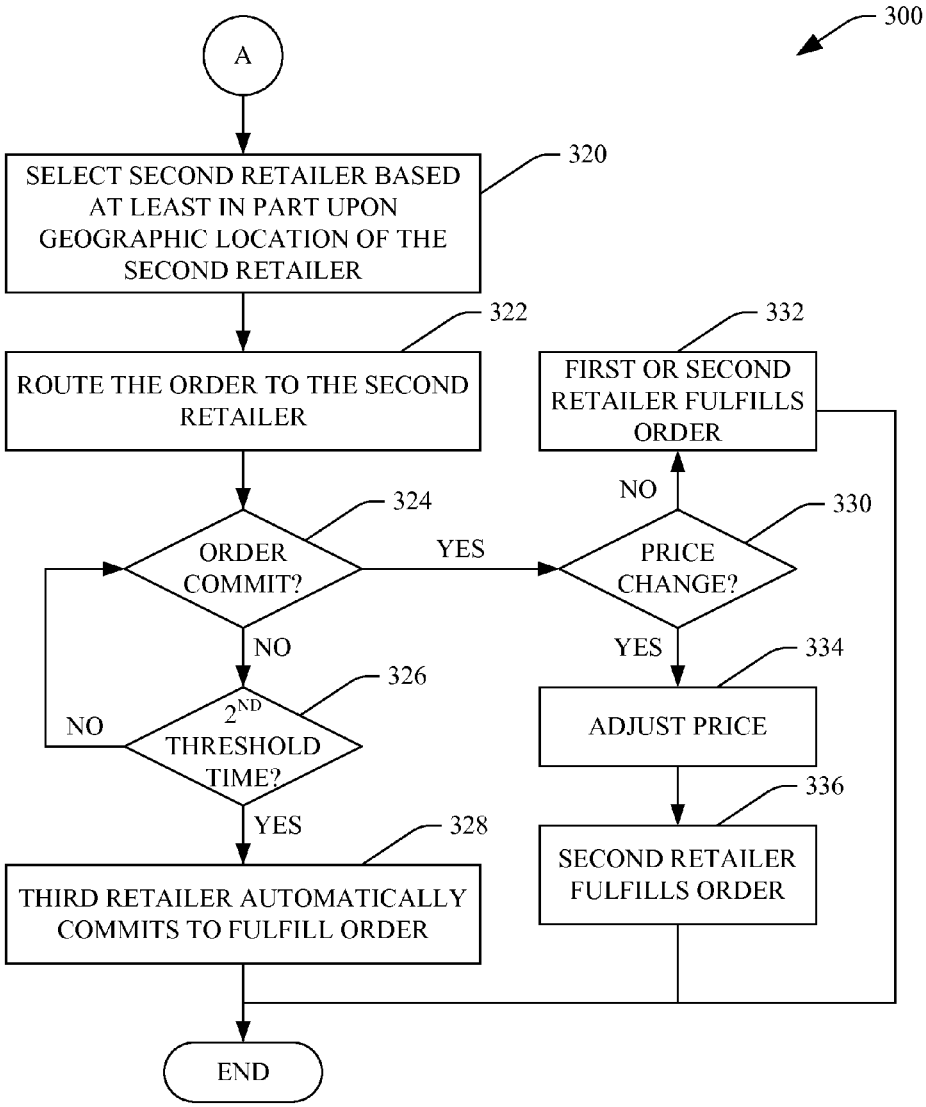

With reference now to FIGS. 3-4, an exemplary methodology is illustrated and described. While the methodology is described as being a series of acts that are performed in a sequence, it is to be understood that the methodology is not limited by the order of the sequence. For instance, some acts may occur in a different order than what is described herein. In addition, an act may occur concurrently with another act. Furthermore, in some instances, not all acts may be required to implement a methodology described herein.

Moreover, the acts described herein may be computer-executable instructions that can be implemented by one or more processors and/or stored on a computer-readable medium or media. The computer-executable instructions may include a routine, a sub-routine, programs, a thread of execution, and/or the like. Still further, results of acts of the methodology may be stored in a computer-readable medium, displayed on a display device, and/or the like. The computer-readable medium may be a non-transitory medium, such as memory, hard drive, CD, DVD, flash drive, or the like.

Referring now to FIG. 3, a methodology 300 that facilitates automatically routing an order from a consumer is illustrated. The methodology 300 begins at 302, and at 304 an order from a consumer for a product from a first retailer for an agreed upon price is received. As described above, the consumer may select a preferred (first) retailer, may select a product that is offered for sale by the first retailer, and may agree to purchase the product for a particular price. At this time, for instance, an authorization for the agreed upon price can be placed on the credit card of the user by or on behalf of the first retailer.

At 306, a determination is made regarding whether or not the order is routable to other retailers. A variety of attributes can be taken into consideration when determining whether or not the order is routable. These attributes can include a type of consumer (whether the consumer is an end user or a business), a type of payment that is going to be employed by the consumer to purchase products in the order, whether one or more products in the order are on backorder, whether one or more products in the order have been recalled for some deficiency, whether products in the order have been selected to be shipped by a particular shipping method, whether the price agreed upon by the consumer and the preferred retailer is a special promotion that is offered only by the first retailer, whether a price for the order includes a particular gross profit margin, amongst other attributes.

If it is determined at 306 that the order is not routable, then at 308 the first retailer must fulfill the order and the methodology ends at 310. In other words, if the order is not routable, completion of the sale is undertaken as is conventional with respect to e-commerce transactions.

If it is determined at 306 that the order is routable, then at 312 a determination is made regarding whether the consumer has chosen to allow routing of the order. If the user has chosen to disallow routing of the order, then the methodology proceeds to 308 where the first retailer fulfills the order.

If, however, at 312 the consumer has selected to allow routing of the order to occur, at 314 a clock is initialized and the order is routed to the first retailer. In an example, the order can be routed in one or more of a plurality of different routing techniques. For instance, the first retailer can have a client side application executing on a computing device resident on the premises of the first retailer, and such client side application can be configured to illustrate to the first retailer that an order has been received and can be committed to by the first retailer. In another example, an e-mail can be transmitted to an e-mail address corresponding to the first retailer. In still yet another example, a text message can be transmitted to a telephone of a particular person at the first retailer. In still yet another example, an application executing on mobile telephone can be in communication with the system 100 described above, and such application can receive an indication that an order has been placed by a consumer, and that the first retailer is able to commit to fulfilling such order.

At 316, a determination is made regarding whether the first retailer has committed to the order. If the first retailer has committed to the order, then the first retailer fulfills the order at 308 and the methodology ends at 310. If the first retailer has not committed to the order, then at 318 a determination is made regarding whether a threshold amount of time has passed. In other words, a value output by the clock can be monitored and can be compared with a threshold value, and at 318 a determination is made regarding whether such threshold amount of time has passed. In the meantime, for instance, reminders can be transmitted to the first retailer that reminding the first retailer that an exclusive right to commit to fulfilling the order of the consumer will expire in a threshold amount of time. These reminders can be text messages, e-mails, graphical indicia appearing on a particular graphical user interface, etc. If the threshold amount of time has not passed, then the methodology 300 returns to 316 where a determination is made regarding whether the first retailer has committed to fulfilling the order.

Referring now to FIG. 4, if the threshold amount of time has been determined to have passed at 318, then at 320 a second retailer is selected based at least in part upon a variety of attributes pertaining to the consume and/or the second retailer. These attributes can include a type of the retailer (e.g., where the retailer is a relatively large or small retailer), a stocking status of one or more parts in the order (e.g., whether such parts are backordered at the second retailer), a geographic proximity of the second retailer to the consumer, type of products in the order, a source of products in the order, a time zone of the consumer when the order was placed, a time zone of the second retailer when the order was placed, etc. While the act 320 describes a second retailer as being selected, it is to be understood that several retailers can be selected for routing of the order based at least in part upon one or more of the factors described above. For the purposes of explanation, however, the description herein has been limited to the second retailer.

At 322, the order is routed to the second retailer. For example, routing of the order to the second retailer can occur in a substantially similar manner as when the order was routed to the first retailer. That is, an application executing on a client side computing device of the second retailer can be updated to indicate to the second retailer that the second retailer can commit to fulfilling the order of the consumer. E-mails, text messages, etc. can be transmitted to the second retailer.

At 324, a determination is made regarding whether or not a retailer that has been provided with the order has committed to fulfilling the order. If it is determined that no retailer has committed to the order, then at 326 a determination is made regarding whether a second threshold amount of time has passed. If the second threshold amount of time has not passed, then the methodology 300 returns to act 324 where a determination is made regarding whether one of the retailers that has received the order has committed to fulfilling the order. If the second threshold amount of time has passed, then at 328 a third retailer can automatically commit to fulfilling the order. In an example, the third retailer can be a parent manufacturer or can be a relatively large retailer. While the methodology 300 has been shown as including review of two time thresholds, as indicated above, it can be understood that the methodology 300 can be adapted to include any suitable number of time thresholds, wherein additional retailers are selected and the order is transmitted to the additional retailers after passage of the threshold amounts of time. Accordingly, retailers can be selected in "waves", and the order can be transmitted to the retailers as the retailers are selected.

If at 324 it is determined that the order has been committed to by the first or second retailer, then the methodology 300 proceeds to 330 where a determination is made regarding whether a change in the price to the consumer may have occurred due to, for instance, changes in shipping cost, changes in sales tax applied to the price, etc. If it has been determined that there has been no price change at 330, then at 332 either the first or second retailer fulfills the order. If at 330 a determination is made that the price charged to the consumer has been altered due to changes in shipping price or changes in sales tax rates, then at 334 the price is adjusted so that the total price agreed to be paid by the consumer is unchanged. In another example, if the price change causes a reduction in price, then such reduction is passed on to the consumer. The methodology 300 then proceeds to 336 where the second retailer fulfills the order. The methodology 300 then completes at 338.

Figure 5:
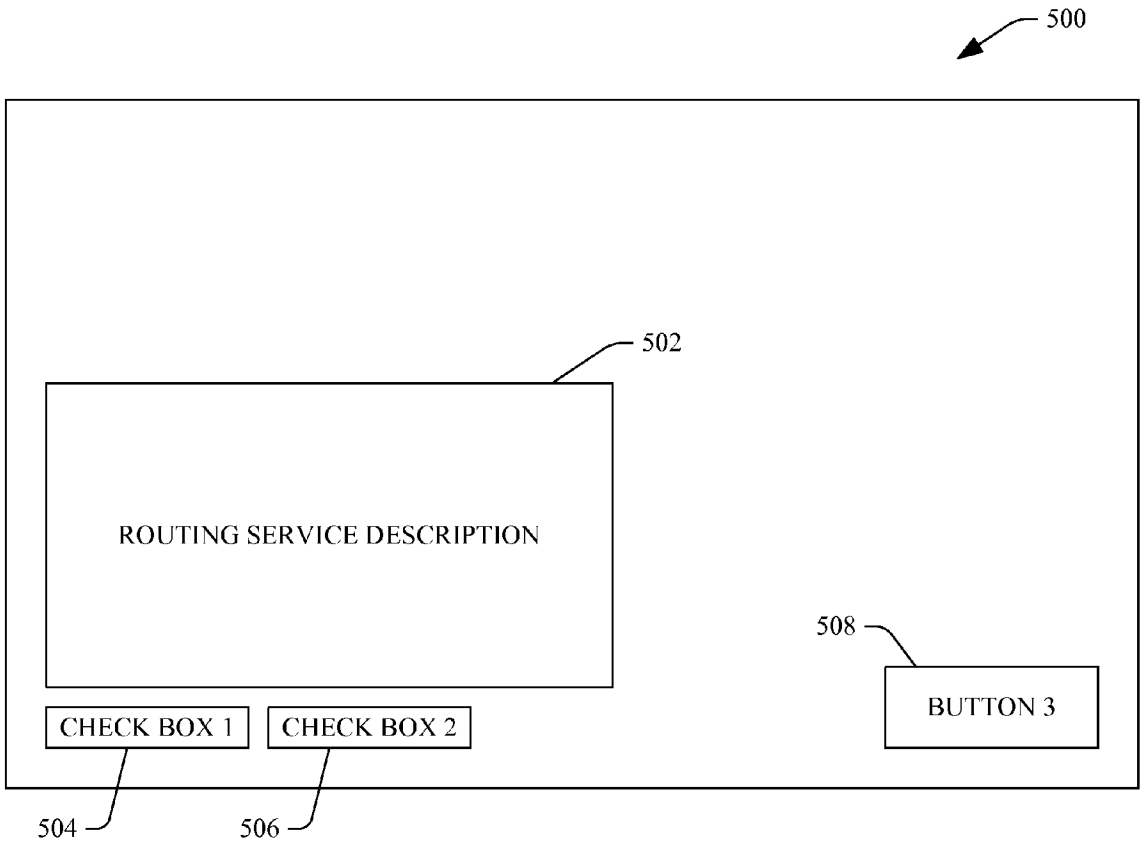
FIG. 5 is an exemplary graphical user interface that can be displayed to a consumer that wishes to purchase a product by way of an e-commerce application.

Referring now to FIG. 5, an exemplary graphical user interface 500 that can be presented to the consumer is illustrated. The graphical user interface 500 comprises a window 502 that includes a description of order routing. Such description of order routing can inform the consumer that if the preferred dealership does not commit to fulfilling the order in a timely manner, the order will be referred to other retailers to provide such retailers an opportunity to commit to fulfilling the order at no additional cost to the consumer. This window 502 can be provided to the consumer if the order desirably placed by the consumer qualifies for the option of order routing. The graphical user interface 500 may further include a first checkbox 504 that can be selected by the user to indicate that the user wishes to have the order routed to other dealerships if the preferred dealership fails to commit to fulfilling the order in a particular amount of time. The graphical user interface 500 can also comprise a second checkbox 506 that is selectable by the consumer to indicate that the consumer has read and understands appropriate terms and conditions of the order routing program. Furthermore, the graphical user interface 500 can comprise a selectable button 508, wherein selection of such button 508 can place the order of the consumer (whether or not the first checkbox 504 has been selected by the consumer). The placing of such order, for example, can cause an authorization to be placed on the credit card of the consumer by or on behalf of the preferred retailer of the consumer for the price of the order placed by such consumer.

Figure 6:
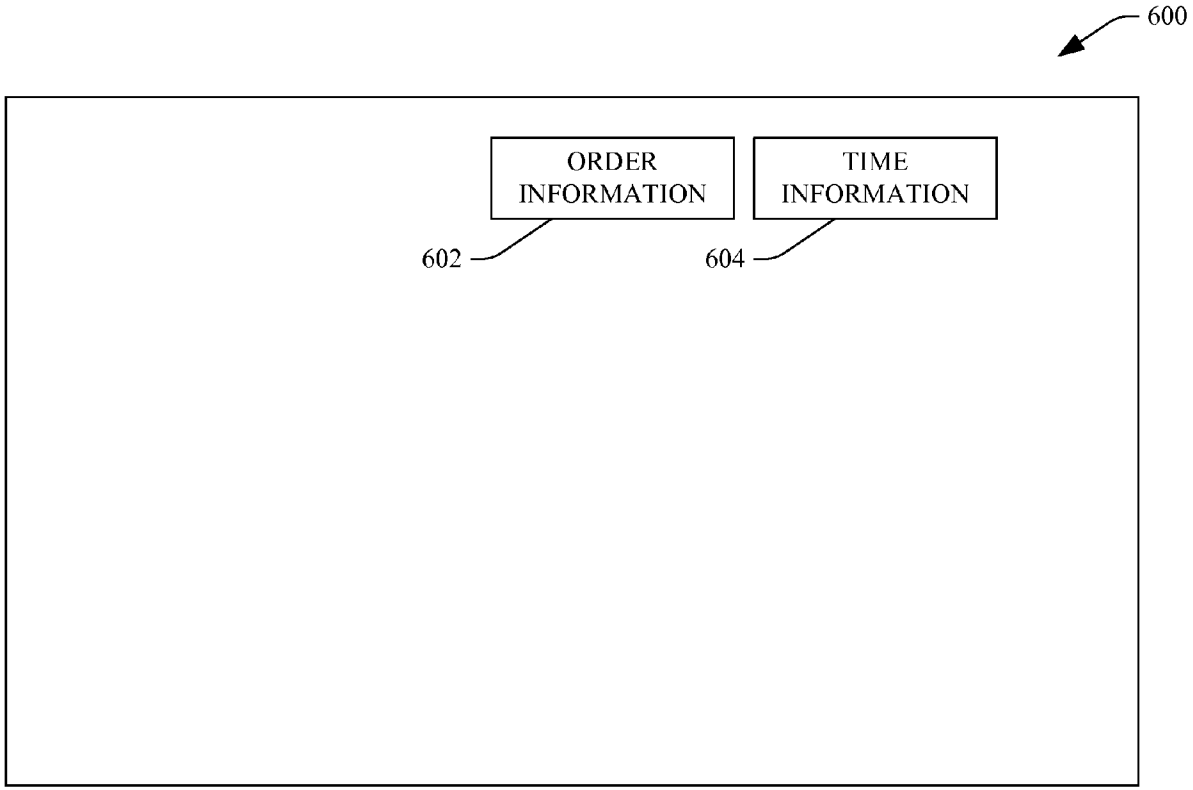
FIG. 6 is an exemplary graphical user interface that can be provided to a seller to display orders that can be fulfilled by such seller.

Now referring to FIG. 6, an exemplary graphical user interface 600 that can be provided to a retailer is illustrated. The graphical user interface 600 can comprise a first field 602 that indicates particular order information, wherein the order information comprises data that indicates to the retailer that the retailer can commit to fulfilling at least one order. The graphical user interface 600 additionally comprises a second field 604 that provides time information to the retailer. This time information can indicate when an order that may be committed to by the retailer is set to expire and become available to other retailers and/or will be auto-committed by a particular retailer. If several orders are available to be committed to by the retailer, the time information 604 for instance can display an amount of time that a soonest to expire order can be committed to by the retailer.

Figure 7:
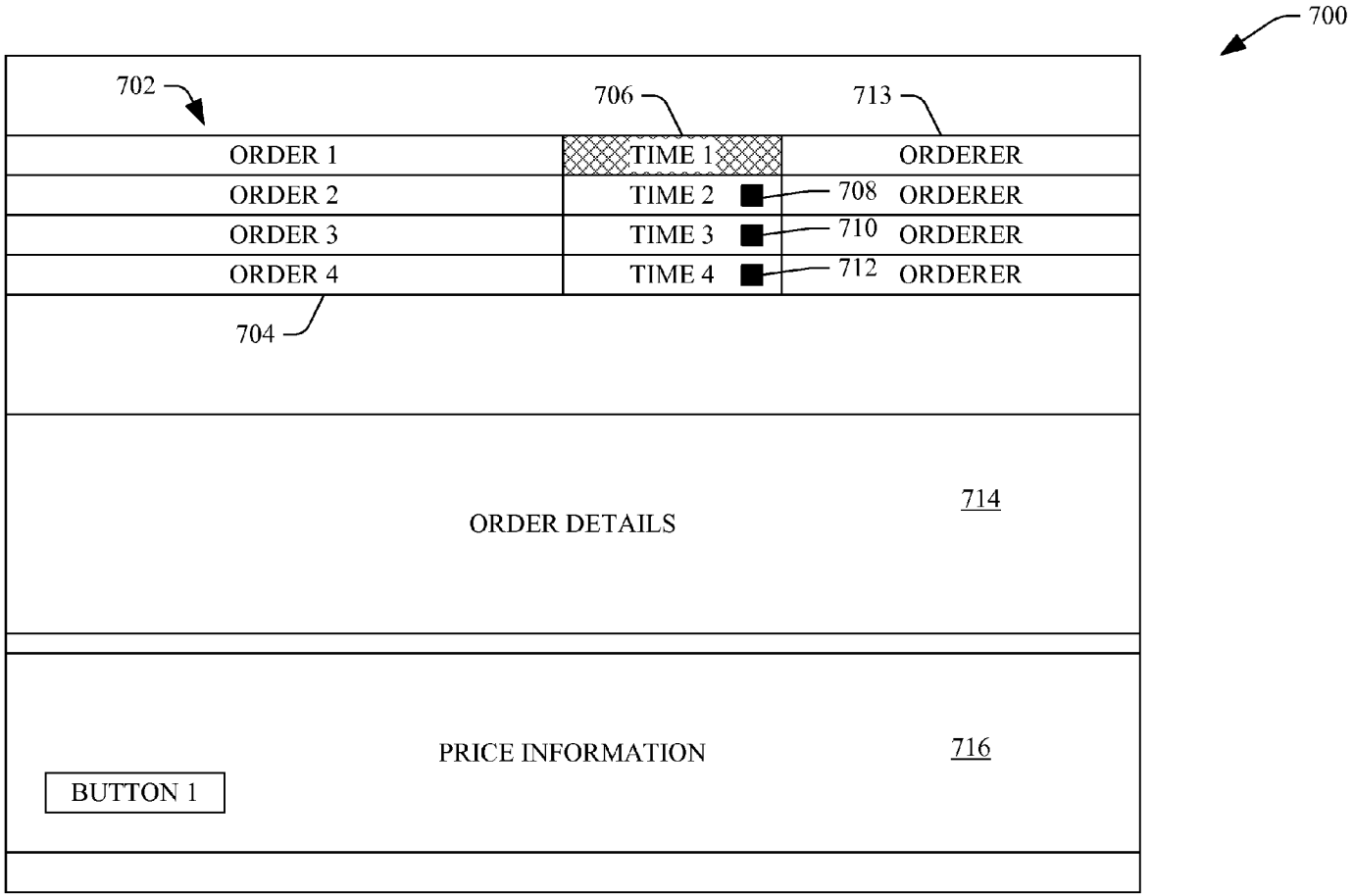
FIG. 7 is an exemplary graphical user interface that facilitates displaying orders that can be fulfilled by sellers.

Referring now to FIG. 7, another exemplary graphical user interface 700 that can be presented to a retailer is illustrated. For instance, the graphical user interface 700 can be presented to the retailer subsequent to the user selecting a button corresponding to the order information 602 shown in the graphical user interface 600 (FIG. 6). The graphical user interface 700 comprises a table 702 that includes order information for one or more orders. In the exemplary graphical user interface 700 four orders are shown in the table 702. In a first column 704 of the table 702, order information can be presented to the retailer. This order information may comprise time that the order was submitted, products included in the order, etc. A second column 706 in the table 702 can indicate to the retailer an amount of time remaining that the retailer has to commit to the order shown in the column 704. For instance, an order shown at the top of the table 702 may have a least amount of time remaining to commit to such order. Furthermore, graphical indicia can be provided in one or more entries of the table to inform the retailer of other attributes pertaining to the order. For example, for the first order, the time entry corresponding thereto can be shaded a particular color to indicate to the retailer that other retailers are able to commit to fulfilling such order. Furthermore, as shown with respect to the second order, third order, and fourth order, graphical indicia 708, 710, and 812 can be provided to the retailer to indicate that the retailer has the exclusive ability to commit to such orders, respectively, within the times corresponding to the indicia in the column 706. The table 702 may comprise a third column 713 that identifies the consumer that placed the order.

The graphical user interface 700 can further comprise a first field 714 that provides a retailer with detailed information pertaining to the order. Such information can include identities of products in the order, quantities of products in the order and price of products in the order.

The graphical user interface 700 may also include a second field 716 that shows price information pertaining to the order shown in the first field 714. This price information can include a tax, a total price of products in the order, an amount of tax that is to be applied to the products in the order, a cost for shipping the products in the order to the consumer, other fees that may be applicable to the order, any discounts that may be applicable to the order, and a total price corresponding to the order. The second field 716 may have at least one button 718 therein that can be selected by the retailer, wherein selection of such button commits the retailer to fulfilling the order described in the fields 714 and 716.

Figure 8:
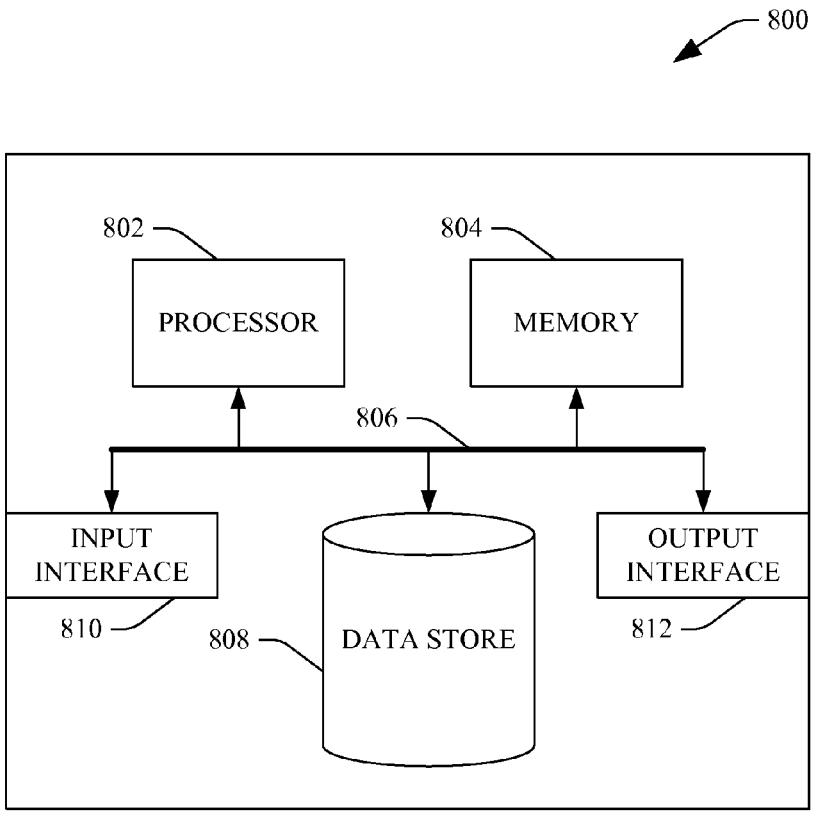
FIG. 8 is an exemplary computing system.

Now referring to FIG. 8, a high-level illustration of an exemplary computing device 800 that can be used in accordance with the systems and methodologies disclosed herein is illustrated. For instance, the computing device 800 may be used in a system that supports placing an order for a particular product by a consumer. In another example, at least a portion of the computing device 800 may be used in a system that supports automatic routing of orders to retailers. The computing device 800 includes at least one processor 802 that executes instructions that are stored in a memory 804. The memory 804 may be or include RAM, ROM, EEPROM, Flash memory, or other suitable memory. The instructions may be, for instance, instructions for implementing functionality described as being carried out by one or more components discussed above or instructions for implementing one or more of the methods described above. The processor 802 may access the memory 804 by way of a system bus 806. In addition to storing executable instructions, the memory 804 may also store rules, consumer attributes, retailer attributes, etc.

The computing device 800 additionally includes a data store 808 that is accessible by the processor 802 by way of the system bus 806. The data store 808 may be or include any suitable computer-readable storage, including a hard disk, memory, etc. The data store 808 may include executable instructions, one or more rules, consumer attributes, etc. The computing device 800 also includes an input interface 810 that allows external devices to communicate with the computing device 800. For instance, the input interface 810 may be used to receive instructions from an external computer device, from a user, etc. The computing device 800 also includes an output interface 812 that interfaces the computing device 800 with one or more external devices. For example, the computing device 800 may display text, images, etc. by way of the output interface 812.

Additionally, while illustrated as a single system, it is to be understood that the computing device 800 may be a distributed system. Thus, for instance, several devices may be in communication by way of a network connection and may collectively perform tasks described as being performed by the computing device 800.

As used herein, the terms "component" and "system" are intended to encompass hardware, software, or a combination of hardware and software. Thus, for example, a system or component may be a process, a process executing on a processor, or a processor. Additionally, a component or system may be localized on a single device or distributed across several devices. Furthermore, a component or system may refer to a portion of memory and/or a series of transistors.

It is noted that several examples have been provided for purposes of explanation. These examples are not to be construed as limiting the hereto-appended claims. Additionally, it may be recognized that the examples provided herein may be permutated while still falling under the scope of the claims.

What is claimed is:

1. A method comprising:

(a) receiving responsive to operation of at least one processor, a selection of an automobile part from a consumer that is desirably purchased by the consumer;

(b) transmitting an order for the automobile part to a first retailer subsequent to receiving the selection of the automobile part from the consumer;

(c) initializing a timer responsive to operation of the at least one processor, subsequent to the transmitting of the order for the automobile part to the first retailer;

(d) comparing responsive to operation of the at least one processor, a value of the timer and a first predefined threshold value;

(e) providing responsive to operation of the at least one processor, indicia accessible by the first retailer indicative that the first retailer has exclusive rights to commit to fulfill the order for the automobile part while the value of the timer is below the first predefined threshold value;

(f) providing responsive to operation of the at least one processor, first graphical indicia accessible by the first retailer, wherein the first graphical indicia is indicative of a current amount of time remaining that the first retailer has exclusive rights to commit to fulfill the order;

(g) transmitting responsive to operation of the at least one processor, responsive at least in part to the value of the timer reaching the first predefined threshold value, the order for the automobile part to a second retailer different than the first retailer;

(h) providing responsive to operation of the at least one processor, second graphical indicia accessible by the second retailer, wherein the second graphical indicia is indicative of a current amount of time remaining that the second retailer has to commit to fulfill the order.

2. The method of claim 1, wherein the first retailer and the second retailer each include automobile dealers.

3. The method of claim 1, further comprising:

prior to (f) selecting the second retailer responsive to operation of the at least one processor based at least in part upon at least one of:

(i) a geographic location of the second retailer, or (ii) a classification assigned to the second retailer.

4. The method of claim 1, wherein the second graphical indicia includes indicia that indicates that the order is fulfillable by the second retailer provided the second retailer commits to fulfill the order within an indicated time period.

5. The method of claim 1, further comprising:

(i) comparing responsive to operation of the at least one processor, a value of the timer with a second predefined threshold, wherein the second predefined threshold is greater than the first predefined threshold;

(j) automatically causing responsive to operation of the at least one processor, responsive at least in part to the value of the timer reaching the second predefined threshold, an entity different than the first retailer to commit to fulfilling the order.

6. The method of claim 5, further comprising:

prior to (j), selecting responsive to operation of the at least one processor, the entity based at least in part upon at least one of:

geographical location of the entity, or classification of the entity.

7. The method of claim 1, wherein the first retailer and the second retailer are each franchises of a common corporation.

8. The method of claim 1, further comprising:

prior to (b), receiving responsive to operation of the at least one processor, a selection from the consumer corresponding to the first retailer, wherein (b) is carried out responsive at least in part to the selection from the consumer.

9. The method of claim 1, further comprising:

receiving responsive to operation of the at least one processor, an indication from the second retailer that the second retailer desires to commit to fulfilling the order; and automatically generating responsive to operation of the at least one processor, an electronic notification to the consumer that informs the consumer that the second retailer is fulfilling the order.

10. The method of claim 1, further comprising:

selecting responsive to operation of the at least one processor, the second retailer from amongst a plurality of different retailers based at least in part upon a type of the automobile part.

11. A method comprising:

receiving responsive to operation of at least one processor, a selection of an automobile part from a consumer that is desirably purchased by the consumer;

transmitting responsive to operation of the at least one processor, an order for the automobile part to a first retailer subsequent to receiving the selection of the automobile part from the consumer;

initializing a timer responsive to operation of the at least one processor, responsive at least in part to the transmitting of the order for the automobile part to the first retailer;

comparing responsive to operation of the at least one processor, a value of the timer and a predefined threshold value;

providing responsive to operation of the at least one processor, exclusive rights to the first retailer to commit to fulfill the order for the automobile part while the value of the timer is below the predefined threshold value;

transmitting responsive to operation of the at least one processor, responsive at least in part to the value of the timer reaching the predefined threshold value, the order for the automobile part to a second retailer;

receiving responsive to operation of the at least one processor, an agreed upon price for the automobile part, wherein the agreed upon price for the automobile part includes sales tax associated with sale of the automobile part, and wherein the first retailer has a first sales tax rate corresponding thereto and the second retailer has a second sales tax rate different than the first sales tax rate, wherein the agreed upon price is based at least in part upon the first sales tax rate;

receiving responsive to operation of the at least one processor, an indication that the second retailer desires to fulfill the order; and modifying responsive to operation of the at least one processor, a non-tax portion of the price for the automobile part based at least in part upon the second sales tax rate, wherein the agreed upon price for the automobile part remains unchanged.

12. A method comprising:

receiving responsive to operation of at least one processor, a selection of an automobile part from a consumer that is desirably purchased by the consumer;

transmitting responsive to operation of the at least one processor, an order for the automobile part to a first retailer subsequent to receiving the selection of the automobile part from the consumer;

initializing a timer responsive to operation of the at least one processor, responsive at least in part to the transmitting of the order for the automobile part to the first retailer;

comparing responsive to operation of the at least one processor, a value of the timer and a predefined threshold value;

providing responsive to operation of the at least one processor, exclusive rights to the first retailer to commit to fulfill the order for the automobile part while the value of the timer is below the predefined threshold value;

transmitting responsive to operation of the at least one processor, responsive at least in part to the value of the timer reaching the predefined threshold value, the order for the automobile part to a second retailer;

subsequent to receiving the selection of the automobile part from the consumer and prior to transmitting the order for the automobile part to the second retailer, placing a first authorization for an agreed upon price for the automobile part on a credit card account of the consumer;

receiving responsive to operation of the at least one processor, an indication from the second retailer that the second retailer desires to commit to fulfilling the order;

subsequent to receiving the indication from the second retailer that the second retailer desires to commit to fulfilling the order, releasing responsive to operation of the at least one processor, the first authorization on the credit card account of the consumer; and subsequent to receiving the indication from the second retailer that the second retailer desires to fulfill the order, placing responsive to operation of the at least one processor, a second authorization on the credit card account of the consumer for the agreed upon price.

13. A non-transitory computer-readable medium comprising instructions that, when executed by a processor, cause the processor to perform acts comprising:

receiving a selection of a first automobile dealership from a consumer;

receiving an order from the consumer for at least one automobile part from the first automobile dealership;

receiving an indication from the consumer that the consumer is willing to have the order routed to one or more other automobile dealerships if the first automobile dealership fails to agree to commit to fulfilling the order in a threshold amount of time;

initializing a clock subsequent to receiving the indication from the consumer that the consumer is willing to have the order routed to the one or more other automobile dealerships;

determining, by monitoring the clock, that the threshold amount of time has passed;

automatically selecting a second automobile dealership based at least in part upon a geographic location of the second automobile dealership with respect to a geographic location of the consumer; and automatically routing the order to the second automobile dealership immediately subsequent to the determining that the threshold amount of time has passed.

14. The computer readable medium according to claim 13, wherein the instructions automatically route the order to the second automobile dealership only if the second automobile dealership will make at least a threshold profit margin fulfilling the order.

15. The computer readable medium according to claim 13 wherein after receiving the selection from the consumer, the instructions are further operative to cause the processor to perform acts including:

receiving an indication from the consumer of an agreed upon price for the order, and placing a first authorization for the agreed upon price on a credit card account of the consumer, and wherein after routing the order to the second automobile dealership, the instructions are further operative to cause the processor to perform acts including:

receiving an indication of a commitment from the second automobile dealership to fulfill the order, automatically releasing the first authorization on the credit card account of the consumer, automatically placing a second authorization on the credit card account of the consumer for the agreed upon price.

16. The computer readable medium according to claim 13 wherein the first automobile dealership and the second automobile dealership are both franchises of a common corporation.

17. The computer readable medium according to claim 13 wherein after routing the order to the second automobile dealership, the instructions are further operative to cause the processor to perform acts including:

automatically committing the second automobile dealership to fulfill the order.

18. The computer readable medium according to claim 13 wherein after receiving the selection from the consumer the instructions are further operative to cause the processor to perform further acts including:

receiving an indication from the consumer of an agreed upon price for the order, wherein the agreed upon price includes, a first component corresponding to a pre-tax price from the order, and a second component corresponding to tax on the order, at a first tax rate, and wherein after routing the order to the second automobile dealership, the instructions are further operative to cause the processor to perform acts including:

receiving a commitment from the second automobile dealership to fulfill the order, automatically determining that tax by the second automobile dealership on the order is at a second tax rate that is higher than the first tax rate, automatically reducing the first component so that the order is fulfilled by the second automobile dealership at no more than the agreed upon price.

19. The computer readable medium according to claim 13 wherein after initializing the clock, the instructions are further operative to cause the processor to perform acts including:

providing at least one graphical output accessible by the first automobile dealership indicative of a time remaining before the order will be routed to another automobile dealership if the first automobile dealership does not agree to commit to fulfill the order.

20. The computer readable medium according to claim 19 wherein after automatically routing the order to the second automobile dealership, the instructions are further operative to cause the processor to perform acts including:

providing at least one further graphical output accessible by the second automobile dealership indicative of a time remaining for the second automobile dealership to agree to commit to fulfill the order, after which the opportunity to fulfill the order will be offered to another entity.

21. At least one non-transitory computer-readable medium including computer executable instructions that when executed by at least one processor are operative to cause a method comprising:

(a) receiving through operation of the at least one processor, an order for an automobile part from a consumer for an agreed upon price;

(b) routing through operation of the at least one processor, the order for the automobile part to a first retailer, wherein the first retailer has an exclusive right to commit to fulfill the order for a time period, wherein the first retailer is associated with a first sales tax rate;

(c) setting between the first retailer and the consumer through operation of the at least one processor, a total price for the automobile part, wherein the total price includes:

(i) a first portion that presents a pre-tax price associated with sale of the automobile part to the consumer, and (ii) a second portion that represents a sales tax associated with sale of the automobile part to the consumer, wherein the second portion is based on the first portion and the first sales tax rate;

(d) determining through operation of the at least one processor that the first retailer has not committed to fulfill the order for the automobile part during the time period;

(e) responsive at least in part to the determination in (d), routing the order through operation of the at least one processor to a second retailer different from the first retailer, wherein the second retailer is associated with a second sales tax rate different from the first sales tax rate;

(f) receiving through operation of the at least one processor, agreement of the second retailer to fulfill the order; and (g) responsive at least in part to (f), adjusting through operation of the at least one processor both the first portion of the total price and the second portion of the total price, based at least in part on the second sales tax rate, wherein subsequent to the adjusting, the total price as set in (c) remains unchanged.

22. The at least one non-transitory computer-readable medium according to claim 21, wherein in (b) the first retailer includes a first automobile dealer, wherein in (e) the second retailer includes a second automobile dealer.

23. The at least one non-transitory computer-readable medium according to claim 21, wherein in (e) the order is routed to the second retailer responsive at least in part to the geographic location of the second retailer relative to the consumer.

24. At least one non-transitory computer-readable medium including computer executable instructions that when executed by at least one processor are operative to cause a method comprising:

(a) receiving through operation of the at least one processor an order for an automobile part from a consumer for an agreed upon price;

(b) routing the order through operation of the at least one processor to a first retailer, wherein the first retailer has exclusive rights to commit to fulfill the order for an amount of time;

(c) determining through operation of the at least one processor that the amount of time has passed without the first retailer committing to fulfill the order;

(d) determining through operation of the at least one processor that a second retailer will make at least a threshold profit margin if the second retailer fulfills the order, wherein the second retailer differs from the first retailer; and (e) responsive at least in part to the determinations in (c) and (d), routing the order through operation of the at least one processor to the second retailer.

* * * * *